United States Patent [19]

Inhofer et al.

[11] 4,240,329

[45] Dec. 23, 1980

[54] FLUID PRESSURE SERVO DETENT MECHANISM

[75] Inventors: Harold G. Inhofer, Hopkins; James J. Kriz, Jr., Minneapolis, both of Minn.

[73] Assignee: Proteus Corporation, Minneapolis, Minn.

[21] Appl. No.: 1,305

[22] Filed: Jan. 5, 1979

Related U.S. Application Data

[63] Continuation-in-part of Ser. No. 825,687, Aug. 18, 1977, abandoned.

[51] Int. Cl.[3] ..... F01L 23/00

[52] U.S. Cl. ..... 91/342; 91/397; 91/398

[58] Field of Search ..... 91/342, 398, 397, 346, 91/410

[56] References Cited

U.S. PATENT DOCUMENTS

| | | | |
|---|---|---|---|
| 575,614 | 1/1897 | Noack | 91/342 |
| 1,067,613 | 7/1913 | Lane | 91/342 |
| 2,698,710 | 1/1955 | Pedroia | 91/342 |
| 3,691,907 | 9/1972 | Paschke | 91/342 |

*Primary Examiner*—Paul E. Maslousky

*Attorney, Agent, or Firm*—James R. Cwayna

[57] ABSTRACT

A fluid pressure servo detent mechanism for controlling movement of a piston within a cylinder including one-way inlet and outlet valves for controlling the fluid pressure within the cylinder with linkage means interconnecting the inlet and outlet valves and the moveable piston for simultaneously actuation thereof. A control or sensing rod is carried by the piston for movement therewith to provide a control element for articles to be controlled or to sense the position of the piston and the flow of fluid or receipt of pressure to the outlet may be utilized to determine the position of the piston and as a signal to additional equipment.

3 Claims, 11 Drawing Figures

FLUID PRESSURE SERVO DETENT MECHANISM

BACKGROUND AND OBJECTS OF THE INVENTION

This application is a continuation-in-part application developed from our previous application, Ser. No. 825,687, filed Aug. 18, 1977, now abandoned, and entitled Fluid Pressure Servo Detent Mechanism, this application disclosing the same and also additional subject matter as appeared in and as was disclosed in such previous application.

FIELD OF THE INVENTION

This invention relates generally to control devices for use with fluid powered devices and more specifically to such a control device which utilizes a pressure differential arrangement to control the various functions within a fluid power system and wherein the operative and fluid flow portions of the unit are entirely self-contained.

The use of pressure actuated servo-control mechanisms is not necessarily totally new in the art. This is true whether the pressure employed for such actuation is a fluid or a gas.

The difficulties that have existed with such prior art devices is the high masses of the elements involved in the system which then requires a high actuating or control pressure, external position sensors and external support systems including external valving to obtain control of the system. A major problem existing with the prior art devices is the stalling of operation normally due to partial or non-full opening and closing of the valving portions of the devices or due to delays between opening and closing of the valving mechanisms.

With applicants' device, the mass of the moveable or moving elements is held to a minimum and all of the moving portions for the valving and control of the device are contained within the unit. Further, with applicants' structure positive valving movement is maintained and obtained through a common linkage between the valving portions which insures simultaneous movement of both the inlet and outlet valves. The positioning of the valves is further assisted by utilization of the pressures within the system.

With applicants' device and structure and the modifications thereof, it is possible to provide a self-contained sensing and control mechanism for fluid power actuators and cylinders which is capable of continuous reciprocation, powered extension in either direction, extension or shifting to a specific position with retraction being provided by external means, extension or positioning at different operative pressures or speeds and extensions or retractions with controlled or cushioned stops.

It is therefore an object of applicants' invention to provide a fluid pressure servo detect mechanism providing a self contained unit which eliminates external valving or sensing mechanisms to determine a desired location.

It is a further object of applicants' invention to provide a fluid pressure servo detect mechanism including a moveable piston contained within a cylinder and inlet and outlet valving means, the action of the valving means being simultaneously controlled by the moveable piston.

It is still a further object of applicants' invention to provide a fluid pressure servo detent mechanism having valving means for the inlet and outlet of fluid under pressure to a moveable piston with means for interconnecting the valving means such that the movement of one such valve will be simultaneously transmitted to the other such valve for combined movement of the valves.

It is yet a further object of applicants' invention to provide a fluid pressure servo detent mechanism having inlet and outlet valves, such valves being arranged and constructed to be held in their desired operative positions by the fluid pressure being delivered to and being within the mechanism.

These and other objects and advantages of applicants' invention will more fully appear from the accompanying disclosure made in connection with the submitted drawings in which the same numeral or indicia is utilized to designate the same or similar parts throughout the several views, and in which.

Figure 1:
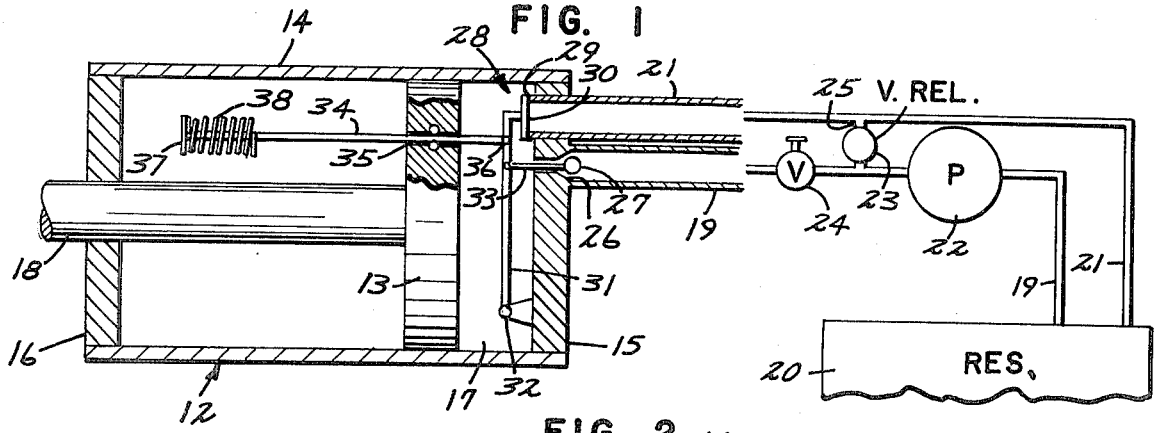
FIG. 1 is a typical longitudinal cross section taken through a first embodiment of a servo detent mechanism of applicants' invention and being illustrated in conjunction with a typical fluid flow system for the operation of the mechanism.
Figure 2:
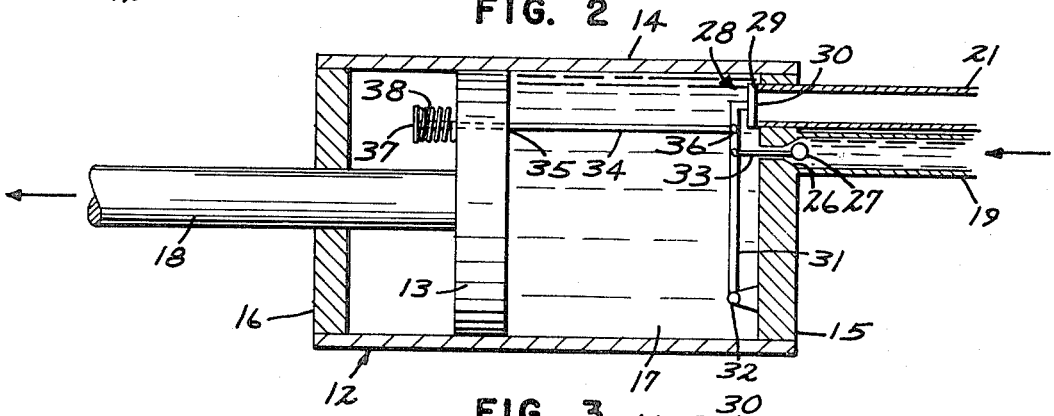
FIG. 2 is a longitudinal cross section of the servo detent mechanism as illustrated in FIG. 1 and illustrating the valving portions thereof in a first position to allow flow to the mechanism.
Figure 3:
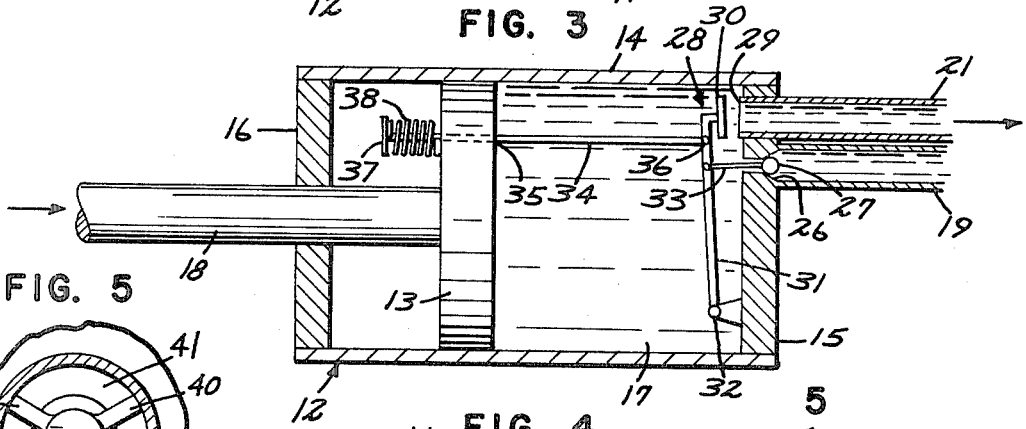
FIG. 3 is a view similar to FIG. 2 but illustrating the valving portions thereof in a second position to allow for the exhaust of fluid from the mechanism.

In accordance with the accompanying drawings, a first form of the invention is illustrated in FIGS. 1 through 3. In the following descriptions, including all the figures, it should be assumed that although the terminology "fluid" is used, that the use of such terminology includes liquids and gases.

As illustrated in FIGS. 1 through 3, the servo detent mechanism is designated in its entirety 12 and a typical fluid system for the use of the mechanism is particularly illustrated in FIG. 1. As shown therein, a fluid reservoir 20 is provided and is interconnected with the mechanism 12 through a delivery or inlet conduit 19 and a return or outlet conduit 21. A pump 22 is provided in the inlet conduit 19 and similarly, a control valve 24 is provided in such inlet conduit. A relief or crossover valve 23 is provided between conduits 19, 21 such that the pump 22 may operate continuously if so desired and the flow will bypass the mechanism 12 depending upon the position of the control valve 24.

As illustrated, the mechanism 12 includes a cylinder providing a cylindrical wall portion 14 and including a pair of end walls 15, 16. A piston 13 is arranged for reciprocatory motion within the cylinder and this piston is provided with a longitudinally extending rod 18 for movement therewith, the rod 18 passing through the end wall 16. This particular rod may be termed to be an actuation device for use to control or initiate the functions of various units. This same rod 18 will, particularly in the form shown in FIGS. 1 through 3 provide a means for driving the piston 13 inwardly, or rearwardly into the cylinder. In the form shown, it should be obvious that some external means must be utilized to displace the piston inwardly and that this form of the invention provides a driving force to the piston 13 and rod 18 in a single direction.

As illustrated, the inlet conduit 19 communicates with the cylinder through a tapered seating and flow passage 26 formed through the end wall 15 such that fluid may be delivered to the pressure chamber 17 formed by the piston 13 and the end wall 15.

The outlet conduit 21 communicates with the cylinder and likewise the pressure chamber 17 through a generally cylindrical passage and valve seat 29, which seat is shown to be positioned slightly inwardly from the end wall 15 of the cylinder.

The combined inlet and outlet valving structure is designated 28 and includes a first primary link 31 having one thereof pivotally connected to end wall 15 as at 32. Arranged on the opposite end of the primary link 31 is a generally flat plate valve member 30 capable for sealing against the generally cylindrical valve seat of conduit 21 and the geometry of the system provides that this plate valve member 30 will properly seat upon the inwardly extending end of conduit 21.

Intermediate the respective ends of primary link 31 is a pivotally mounted secondary link 33 which passes through the inlet passage 26 and which is provided with a valve closure element such as a ball valve 27 for seating against the tapered inlet passage 26. It should be noted that this ball valve is located externally of the end wall 15 and is exposed to the flow of fluid into the mechanism 12 such that when the same is in sealing position, the pressure acting thereagainst from inlet conduit 19 will aid in positive sealing of the valve element 27 against the tapered inlet and seat 26.

From this combination of the two valving elements 27 and 30 being carried by the same primary link 31, it should be obvious that their opening and closing actions will be simultaneous. This coaction then insures that full opening and full closure will be simultaneously obtained and this coaction prevents any "stalling" or flow obstructions.

Actuator means for shifting the inlet 27 and outlet valve 30 include an actuator rod 34 pivotally attached to the primary lever or link 31 and extending therefrom into the cylinder and, as illustrated, sealingly, slideably through the piston 13, as through a sealing passage 35 formed through the piston 13. The pivotal connection of the actuator rod 34 to the primary link is indicated at 36. An enlarged head or boss 37 is provided on the opposite end of actuator rod 34 and, as shown, this head is disposed on the side of piston 13 opposite from the pressure chamber side 17. A compression spring or similar biasing member 38 is interposed between the enlarged head 37 and the piston 13.

With the mechanism as illustrated in FIGS. 1 through 3, it should be obvious that powered motion is provided to the piston 13 and associated piston rod 18 in a right to left direction and in order to provide a left to right movement, as illustrated specifically in FIG. 3, an external force must be supplied to the rod 18. The powered motion of rod 18 may be used to actuate other devices, produce a signal or otherwise produce a control function.

The operation of the mechanism as illustrated in these figures should be obvious. Assuming that the piston has been moved to its innermost position, it will physically contact the primary link 31 and physically shift the valve elements 27 and 30 to their respective open and closed positions. This position will allow fluid under pressure to enter the pressure chamber 17 through the inlet passage 16 and this pressure within chamber 17 will assist in sealing of the plate valve 30 against the outlet conduit 29. It should be noted that as the outlet conduit is at low pressure any pressure within the chamber 17 will aid in such sealing. As the fluid under pressure enters chamber 17 from the inlet conduit 19 movement of piston 13 to the left will result. As the piston moves to the left, it will come into contact with the biasing member 38 and cause the same to compress. By proper selection of this biasing member, compression will continue until the spring force of the member 38 overcomes the pressure in the chamber 17 acting against the outlet, plate valve 30. This will cause the rapid opening of the outlet valve member 30 from the conduit seat 29 and simultaneously therewith will bring the ball, inlet valve member 27 against the tapered sealing passage 16 to prevent further entrance of fluid into chamber 17.

It should be noted that the biasing member 38 insures such positive opening. If the piston 13 were simply to abut with the enlarged head 37 and thereby cause the actuator rod 34 to shift the primary link 31 and thus the valves, the movement would be relatively slow and the valves could both be in a partially open stage. The effect of the biasing member 38 is to provide a positive shifting of the valving members as it is only necessary to compress the spring 38 to the point where it will overcome the pressure within the chamber 17 acting against the outlet valve 30 to, by spring force, cause the valve shifting.

When the shifting of the valves has been achieved, the mechanism will assume the position as illustrated in FIG. 3 wherein the outlet valve 30 is open and the inlet valve 27 is closed. It should be noted that, with the inlet valve in this closed position, high pressure fluid acts thereagainst to assist in sealing and closing.

At this point in the operation, a force applied to cause the piston 13 to move to the right will cause fluid to pass through the outlet conduit 21 into an area that may be classified as a low or no pressure area, this area being a reservoir in the case of a hydraulic fluid or atmosphere in the case of air pressure being used.

Continued movement of the piston 13 to the right by such external force will ultimately bring the piston 13 into contact with the primary link 31 to shift the same and the associated valves into the position of FIGS. 1 and 2.

It should also be noted that with the mechanism as shown, that upon the opening of the outlet valve, and particularly upon the piston 13 being moved to the right to cause expulsion of fluid from the pressure chamber 17, a flow will result in the conduit 21. Means to sense such flow, or particularly in a hydraulic useage, means to sense the presence of fluid in the outlet conduit 21 may be provided to serve as an additional indicator of the movement and position of the piston 13.

Figure 5:
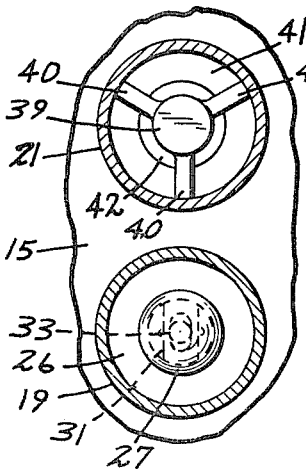
FIG. 5 is a transverse section taken substantially along Line 5—5 of FIG. 4.
Figure 4:
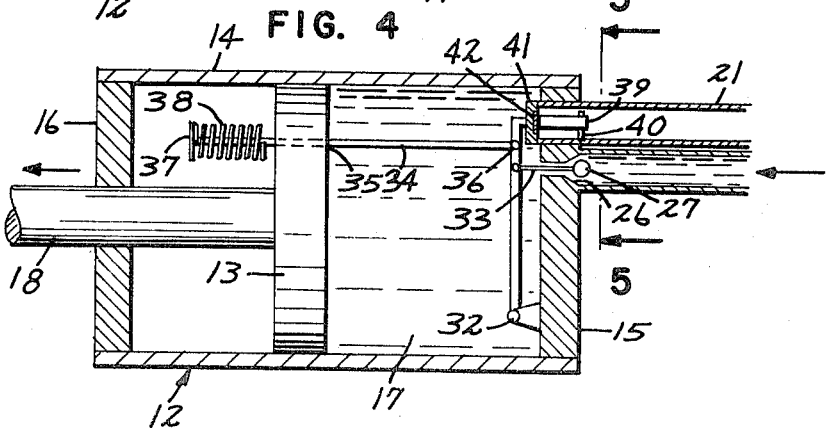
FIG. 4 is a longitudinal cross section of a first modified form of the servo detent mechanism of applicants' invention.

The first modified form of the invention and the elements thereof are illustrated in FIGS. 4 and 5. The basic structure of the mechanism of FIGS. 1 through 3 exists in this modified form and the identical parts are designated with the same numerals as used in FIGS. 1 through 3. The primary modification as disclosed and shown in connection with these views is the inclusion of magnet, either of the permanent type or of the electromagnet type, such magnet being designated 39 and being located and supported within the outlet conduit 21 by a mounting spider and the inclusion of a magnetic material located in the outlet valving plate. In these views, the outlet valving plate is designated 41 and the magnetic material located on the outboard end or side thereof is designated 42. The spider for mounting of the magnet 39, in the form shown, consists of a tri-legged element with each of the legs being designated 40. It should also be noted that the magnetic material located in the outlet valve 41 is of a size to be received within the outlet conduit with the sealing surface circumscribing the same such that the magnet 39 and the magnetic material 42 will be in close proximity for maximum magnetic force application.

The use of this magnetic arrangement is of particular importance when utilizing relatively low pressures and particularly at the initiation of a cylinder expansion cycle. This magnetic arrangement will hold the outlet valve closed until sufficient pressure within the pressure chamber 17 accumulates and will assist in holding the inlet valve in open position during this period, the inlet fluid tending to shift the inlet valve 27 into a closed position simply due to the direction of flow and the pressure exerted thereagainst.

It should also be noted that the biasing spring 38 must be calculated to provide for shifting of the valving structure at a spring force to compensate for the pressure within the pressure chamber 17 tending to maintain the valve 41 in closed position and against the magnet force exerted by this magnetic combination. This situation does provide an added "snap" opening condition to insure full opening of the outlet and full closing of the inlet when the piston 13 contacts the biasing member 38 as a greater longitudinal force must be applied to actuator rod to overcome this combined pressure and magnetic force arrangement.

It should also be noted that a more positive shifting of the valving members will take place when the piston 13 is moved to the right to exhaust fluid from the pressure chamber 17. In the form of FIGS. 1 through 3, the shifting was accomplished strictly through the physical contact of the piston 13 with the link 31. With the addition of the magnet and magnetic material, an additional closing force is provided to insure such shifting to close the outlet valve and open the inlet valve.

If an electromagnetic arrangement is selected, an even greater latitude is provided.

It should be noted that the entire sealing surface of the valving plate could be provided of magnetic material if the material were selected from those materials, presently available, that are of a deformable or resilient quality.

The operation of this first modified form of this invention is identical to that described for FIGS. 1 through 3 with the exception of this magnetic consideration.

Figure 6:
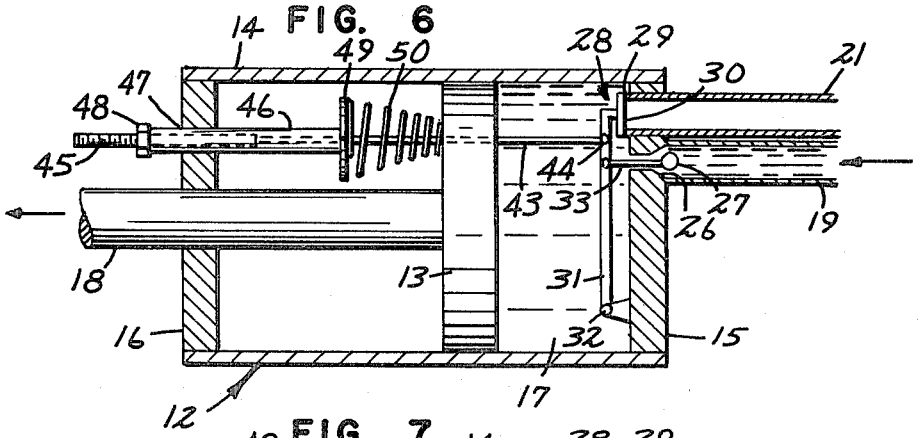
FIG. 6 is a longitudinal cross section of a second modified form of the servo detent mechanism of applicants' invention.
Figure 7:
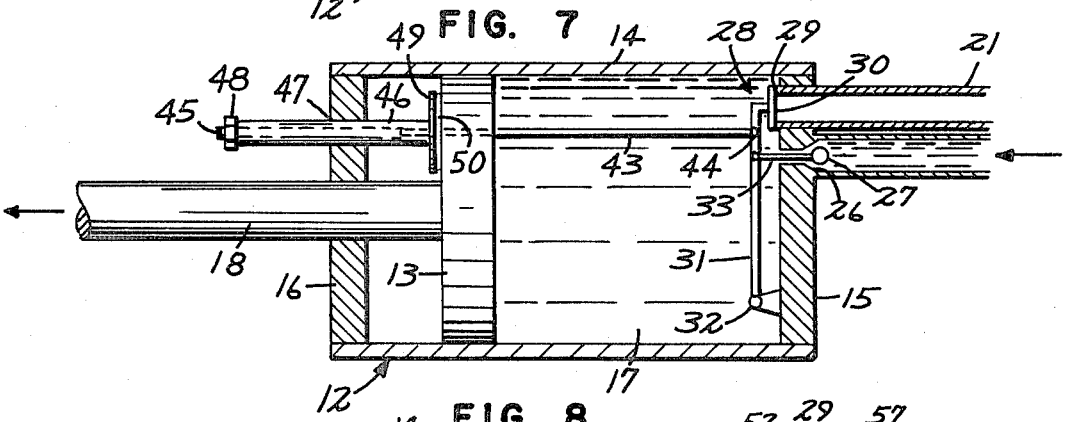
FIG. 7 is a view similar to FIG. 6 but illustrating the operative portions thereof in a shifted position.

A second modified form of the invention is illustrated in FIGS. 6 and 7. In this form of the invention means to adjust the allowable travel of the piston 13 before the valving arrangement is shifted are provided. Again, in this modified form and in these Figures, the same numerals are utilized to identify those parts that are identical in FIGS. 1 through 3.

The means for adjustment of the shifting position is encompassed through a modification of the actuator rod which is connected to the primary link 31. In this form of the invention, an elongated rod 43 having one end thereof 44 pivotally attached to the primary link 31 extends sealingly through the piston 13 and through the end wall 16 of the cylindrical mechanism 12. The extending end 45 of this rod 43 is threaded along a portion thereof and is received into an internally threaded sleeve element 46, the sleeve element 46 being arranged to longitudinally slide through a passage in end wall 16. The innermost end of the threaded sleeve 46 is provided with a radially extending flange 49 and a biasing member 50 is interposed between such flange 49 and the piston 13. In the form shown, this biasing member includes a conical compression spring having its larger end disposed against flange 49 and the smaller end arranged against the piston 13.

As illustrated, a lock nut 48 is provided on the threaded end of rod 43 to abut with the end of the threaded sleeve 46 and positively position the same after setting thereof. Two different settings of the sleeve 46 with respect to the threaded rod 43 are illustrated in these Figures and it should be obvious that such shifting and positioning will shift the position of the flange 49 and thus the distance that the piston 13 will travel prior to contacting the biasing member 50 and therefore the distance that the piston 13 will travel prior to cause the valving members to shift.

The obvious advantage of this adjustment feature is to provide a piston travel adjustment but most important to the structure shown for adjusting is the feature of external adjustment which may be accomplished while the mechanism is operating.

Again, the operation of this unit is the same as that described for the form illustrated in FIGS. 1 through 3 with the added adjustment feature.

Figure 8:
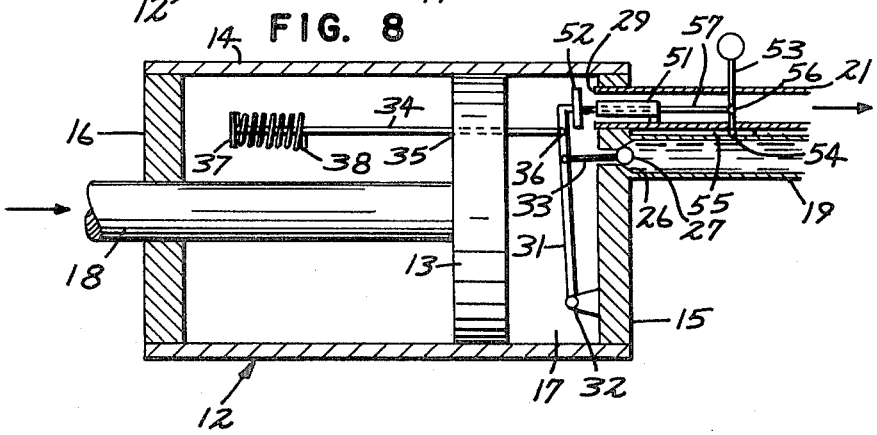
FIG. 8 is a longitudinal cross section of a third modified form of the servo detect mechanism of applicants' invention.

The third modified form of the invention is illustrated in FIG. 8. Again, the basic structure of this modified form is the same as the mechanism illustrated in FIGS. 1 through 3 and for those elements and parts that are the same, the same numerals of identification are used.

This form of the invention provides a means to override the automatic opening and closing of the valving elements and thus provides a means to control the movement of the piston 13 with such control being provided externally of the mechanism. With such control, the piston travel may be stopped, restarted or reversed, the reversal being achieved through an external source as previously stated.

In this form of the invention, a magnet 51 is mounted in the outlet conduit 21 in the same manner as discussed for FIGS. 4 and 5 and the outlet valving plate 52 is again provided of a magnetic material. The unit then, to this point, will operate in the same manner as that of FIGS. 4 and 5.

The override control, in the form shown, provides a means to mechanically displace the outlet valve plate 52 from the magnet 51 and to accomplish this displacement, a lever system is utilized. A first rigid rod 57 is provided to move longitudinally within the conduit 21 such that it may be moved against the valve outlet plate 52 to displace the same from sealing position and an actuating linkage including a lever member 53 having one end 54 pivotally attached to a bracket 55 with an intermediate portion attached to rod 57 as at 56 is provided which lever 53 extends externally of the conduit 21 for actuation and movement thereof to thus shift the valve 52. It should be obvious that sealing means must be provided for the actuating lever 53 if a hydraulic system is used but such seals are common to the art.

The operation of this modified form is again, identical to the operation of the unit of FIGS. 1 through 3 with the addition of this manual override which, as stated, permits control of the piston travel.

Figure 9:
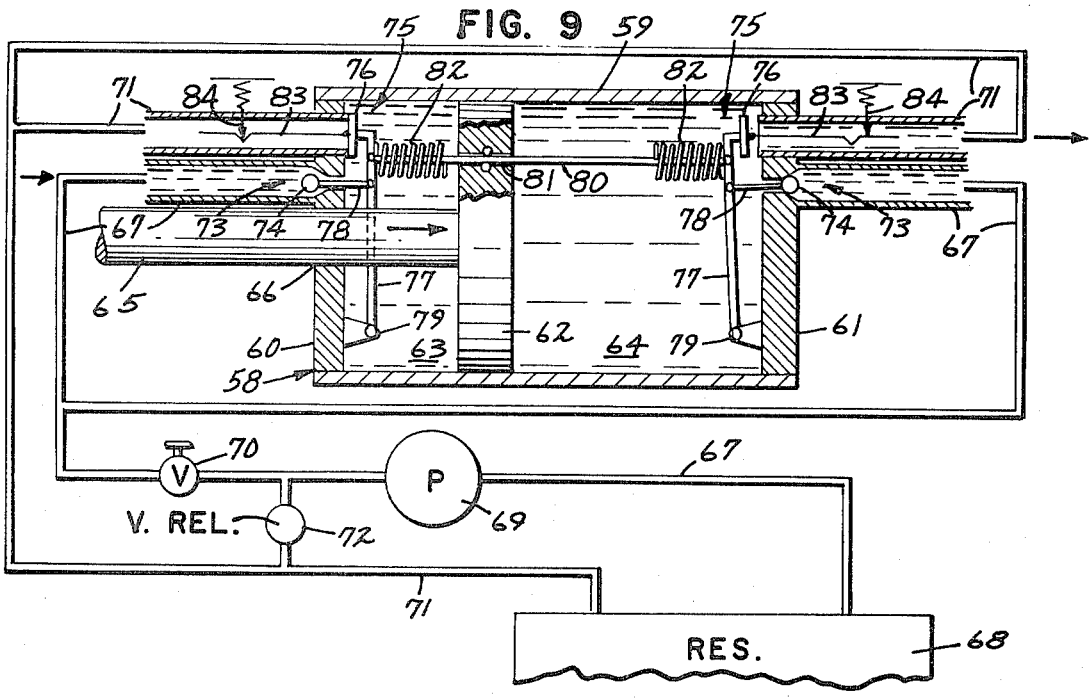
FIG. 9 is a longitudinal cross section of a fourth, reciprocatory form of the servo detent mechanism of applicants' invention and illustrated in conjunction with a typical fluid flow system for the operation of the same.
Figure 10:
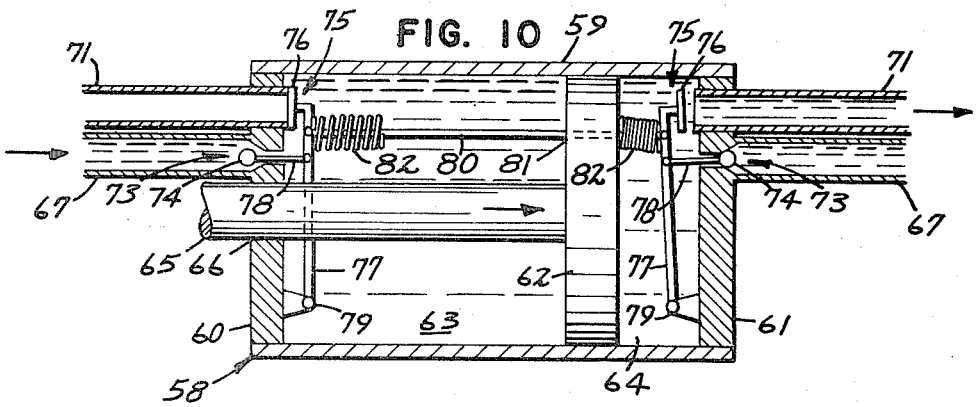
FIG. 10 is a view similar to FIG. 9 and illustrating the elements thereof to control movement of the piston in a first direction.
Figure 11:
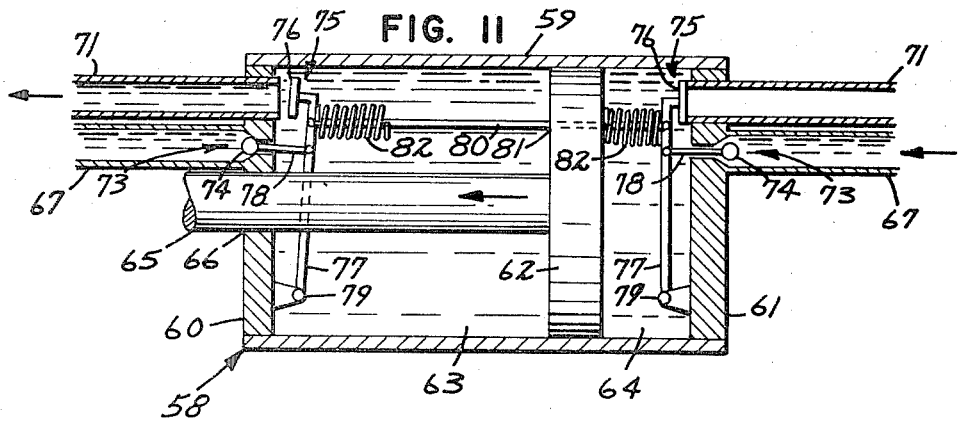
FIG. 11 is a view similar to FIG. 10 and illustrating the elements thereof to control movement of the piston in a direction opposite to that illustrated in FIG. 10.

To this point of the disclosure the mechanisms described will provide a means to power the piston 13 in one direction with means required to move the same in the opposite direction. The fourth modified form of the invention is illustrated in FIGS. 9 through 11 and this form of the invention provides a means to reciprocate a piston by providing and exhausting fluid under pressure alternately from opposite sides of the piston. This form of the invention incorporates the same basic valving mechanism as hereinbefore disclosed but positioned on both sides of the cylindrical assembly and on both sides of the moveable piston.

In the form shown in FIGS. 9 through 11 the mechanism is designated 58 in its entirety and includes a generally cylindrical member 59 having end walls 60, 61 with a moveable piston arranged therebetween, designated 62, to provide a pair of pressure chambers 63, 64 within the cylinder and having a piston rod 65 secured to piston 62 for movement therewith and, in the form shown, extending through the side wall 60, although it should be obvious that a single rod is a matter of choice and the wall through which it extends is a matter of choice. As illustrated, the rod 65 passes through a sealing aperture or passage 66 through the end wall 60.

FIG. 9 also discloses a fluid delivery and return system for powering the piston movement.

As illustrated in FIG. 9, a reservoir 68 is provided and a fluid inlet or delivery line 67 is provided therefrom to a pump 68 from which such line extends therefrom to a control valve 70 and thence to the inlets 67 in each of the end walls 60, 61. A fluid return or outlet line or conduit 71 is provided to receive fluid from each end of the cylinder, through the respective end walls 60, 61 and return fluid to the reservoir. A relief valve 72 is provided between the fluid delivery and return lines 67, 71 to allow the pump 69 to operate continuously.

In the form shown, identical valving systems and interconnections for the same are provided on each of the end walls 60, 61 and each includes an inlet valve section 73 which includes a ball sealing valve 74 and an outlet valve section 75 which includes a plate sealing valve 76. A primary link 77 is provided for each such system and is pivotally connected to the respective end wall as at 79 with the opposite end thereof secured to the outlet plate valves 76 and an intermediate portion thereof pivotally connected to a rigid link member 78 which extends to the ball valve 74 controlling the inlet flow. Again, the interconnection of the valving elements provides for simultaneous opening and closing of the valves in either of the systems.

The means for operating both of the valving systems includes a rigid rod member to extend between and pivotally connected to the respective primary links 77 of the valving systems. This rod 80 is slidingly and sealingly provided through passage 81 in piston 62 and a pair of biasing members 82 are respectively positioned about such rod 80 on either side of piston and interposed between the piston 62 and the respective primary links 77 of the valving systems.

An additional holding mechanism for the valving systems is provided in each of the outlet conduits 71 and this includes a notched, longitudinally extending member 83 secured to the respective valving plates 76 in combination with a spring loaded detent element 84 which engages the notched member to releasably hold the valving plate in a closed position.

As illustrated in FIGS. 9 through 11, the actuator and control rod 80 is of such a length to cause one set of valving elements in one position while maintaining the other set of elements in an opposite position. In this manner, fluid will be provided to one of the pressure chambers while fluid is being exhausted from the opposite chamber and upon switching of the valving systems due to the movement of the piston 62 the alternative condition will exist to cause the piston to travel in the opposite direction.

The action of this form of the invention, when considering motion in either direction, is identical to that described for the single ended mechanism of FIGS. 1 through 3. When the piston 62 is caused to move in either direction, it will ultimately abut with one of the springs and upon sufficient compression thereof the spring will, in combination with the piston movement, overcome the pressure in the pressurized chamber tending to hold the outlet valve in closed position and will also overcome the detent pressure and cause the shifting of the valve sections. This common shifting is furthered by the connecting rod 80 such that all four of the provided valves will be simultaneously shifted.

With the reciprocatory structure as disclosed in these views, it should be obvious that the speed of reciprocation is controlled through the control valve 70.

It should be obvious that all of the forms of the invention disclosed herein provide a means for shifting a member in at least a single driven direction and that each incorporates a control mechanism for such movement that is internally contained and which will provide, through the incorporation of biasing members to overcome supplied pressures a positive means for fully shifting the valving mechanisms necessary to prevent stalling or throttling of the moveable, driven element.

What is claimed is:

1. A fluid pressure servo detent mechanism including:

a. a cylinder having a pair of closed end walls;

b. a piston moveable within said cylinder and providing a pressure chamber on each side thereof;

c. inlet means for introducing fluid under pressure to each of said pressure chambers to provide motion to said piston in a direction opposite to the introduction of fluid and to thereby provide expansion of such chamber;

d. outlet means for receiving fluid from each of said shambers to permit said piston to reduce the size of such chamber;

e. first valving means arranged to control each of said inlet means and positioned to be held in closed position by the fluid under pressure being delivered to the respective pressure chamber;

f. second valving means arranged to control each of said outlet means and positioned to be held in closed position by the pressure of the fluid within the respective pressure chamber;

g. link means interconnecting each of such first and second valving means whereby said first valving means of each pressure chamber is shifted to an open position when said second valving means of each pressure chamber is shifted to a closed position and said first valving means of each pressure chamber is shifted to a closed position when said second valving means of each pressure chamber is shifted to an open position; and h. actuator means interconnecting said link means for shifting thereof to simultaneously deliver fluid under pressure to one of said pressure chambers while exhausting fluid from the other of said chambers.

2. The structure set forth in claim 1 and said actuator means associated with said piston for movement thereby.

3. The structure set forth in claim 2 and biasing means associated with said actuator means for abutment with and movement by said piston whereby said biasing means provides movement of said actuator means upon prdetermined movement of said piston.

* * * * *